US007215187B2

(12) United States Patent
Lam et al.

(10) Patent No.: US 7,215,187 B2
(45) Date of Patent: May 8, 2007

(54) SYMMETRICALLY MATCHED VOLTAGE MIRROR AND APPLICATIONS THEREFOR

(75) Inventors: Yat Hei Lam, New Territories (HK); Wing Hung Ki, Kowloon (HK); Chi Ying Tsui, Kowloon (HK)

(73) Assignee: The Hong Kong University of Science and Technology, Kowloon (HK)

( * ) Notice: Subject to any disclaimer, the term of this patent is extended or adjusted under 35 U.S.C. 154(b) by 0 days.

(21) Appl. No.: 11/185,294

(22) Filed: Jul. 20, 2005

(65) Prior Publication Data

US 2006/0017495 A1 Jan. 26, 2006

Related U.S. Application Data

(60) Provisional application No. 60/590,356, filed on Jul. 23, 2004.

(51) Int. Cl.
*G05F 1/10* (2006.01)

(52) U.S. Cl. ..... 327/543

(58) Field of Classification Search ..... 323/315, 323/316; 327/535, 537, 538, 540, 541, 543, 327/545, 546

See application file for complete search history.

(56) References Cited

U.S. PATENT DOCUMENTS 4,910,480 A * 3/1990 Crosby ..... 330/288
5,300,837 A * 4/1994 Fischer ..... 327/281
5,680,037 A * 10/1997 Carobolante ..... 323/315
5,757,175 A * 5/1998 Morishita et al. ..... 323/315
5,939,933 A * 8/1999 Wang ..... 327/512
6,166,529 A * 12/2000 Ikeuchi et al. ..... 323/315
6,326,836 B1 * 12/2001 Kipnis ..... 327/538
6,351,181 B1 * 2/2002 Vittoz ..... 327/541
6,452,453 B1 * 9/2002 Fujioka et al. ..... 330/288
6,509,855 B1 * 1/2003 Cable ..... 341/144

* cited by examiner

*Primary Examiner*—Jeffrey Zweizig
(74) *Attorney, Agent, or Firm*—Heslin Rotherberg Farley & Mesiti P.C.

(57) ABSTRACT

A voltage mirror circuit using a symmetrically matched transistor structure is provided. The circuit includes an input reference voltage node on a first side of said circuit and an output mirror voltage node on a second side of said circuit, and a plurality of matched transistor pairs wherein the transistors in each pair have the same aspect ratio and wherein one transistor in each pair is provided on the first side of the circuit and the second transistor in each pair is provided on the second side of said circuit. The transistor pairs may include pairs of NMOS transistors and pairs of PMOS transistors or pairs of bipolar npn transistors and pairs of bipolar pnp transistors.

22 Claims, 5 Drawing Sheets

SYMMETRICALLY MATCHED VOLTAGE MIRROR AND APPLICATIONS THEREFOR

CROSS-REFERENCE TO RELATED APPLICATIONS

This application claims priority from U.S. Provisional Application No. 60/590,356, filed Jul. 23, 2004. This Provisional Application is hereby incorporated herein by reference in its entirety.

FIELD OF INVENTION

This invention relates to voltage mirror techniques. More specifically, the invention relates to the use of symmetrically matched transistor structures to construct voltage mirrors with reduced systematic offset such that the voltage mirrored is identical to the voltage being mirrored. Embodiments of the invention may be used in circuits that need voltage mirroring, such as current sensors, bandgap references, low dropout regulators, current mirrors, and current conveyors.

BACKGROUND OF THE INVENTION

A voltage mirror is a circuit that forces two of the nodes in a circuit to have the same voltage potential. The voltage being mirrored is called the reference voltage ($V_X$), and can be considered as the input of the circuit, and the voltage mirrored is called the mirror voltage ($V_Y$), and can be considered as the output of the circuit. In some applications, a high-gain high-speed operational amplifier may be used to implement a voltage mirror, as shown in FIG. 1. The reference voltage $V_X$ is connected to the positive input terminal of the operational amplifier, while the output terminal is connected to the negative terminal of the operational amplifier. The feedback mechanism forces the negative terminal to have the same potential as the positive terminal, such that $V_Y=V_X$, and $V_Y$ is then the mirror voltage of $V_X$. The performance of the operational amplifier, such as steady state error, transient response, minimum supply voltage, power consumption and dynamic range, determines the accuracy of the voltage mirroring. If the supply voltage is very low, the design of the operational amplifier with a high gain, high bandwidth, wide input common mode range, wide output swing and low power consumption is a very challenging task.

In some applications, a voltage mirror may be implemented by using a matched current source technique, as shown in FIG. 2. If two transistors have the same corresponding gate, drain and source voltages, they will have the same current densities, where the current density of a MOS transistor is defined as the ratio of its drain current to its aspect ratio (W/L ratio). In FIG. 2, transistors $M_{201}$ and $M_{202}$ with the same W/L ratio are biased with two matched current sources $I_{b1}$ and $I_{b2}$, such that $I_{b1}=I_{b2}$. Therefore, $M_{201}$ and $M_{202}$ have the same gate to source voltages, and with a common gate configuration, their source voltages $V_X$ and $V_Y$ are forced to be the same. This voltage mirror is very simple and the speed is moderate, but it suffers from systematic offset error introduced by the different drain to source voltages of $M_{201}$ and $M_{202}$, and the mirroring accuracy is not high. The two current sources may be replaced by a self-biased structure composed of transistors $M_{303}$ and $M_{304}$, as shown in FIG. 3. However, systematic offset exists for $M_{303}$ and $M_{304}$, because they have different drain to source voltages, and the mirroring accuracy is not high.

One major application of voltage mirrors is in designing integrated current sensors that are widely used in switching converters for current mode control and over-current protection. Prior approaches include using current sensing resistors and current transformers. Sensing resistors dissipate much power, and current transformers are too bulky and expensive. Integrated current sensors dissipate a very small power and their sizes are small compared to the power transistors, and the production cost can be much reduced.

FIG. 4 shows an example of using a voltage mirror in sensing the current through the power transistor $M_{401}$. The size of the power transistor $M_{401}$ to the size of the sensing transistor $M_{402}$ is N:1, with N>1. The voltage mirror forces the voltages $V_X$ and $V_Y$ to be equal, and the current density of the two transistors are then the same. With $M_{401}$ N times larger than $M_{402}$, then $I_1=NI_2$. Therefore, the main current of $M_{401}$ is monitored by a much smaller current of $M_{402}$.

Current sensing may also be achieved by using current sensing resistors. FIG. 5 shows a current sensing resistor $R_1$ that has a very low value. A traditional method may monitor the voltage across $R_1$, and the current is given by $I_1=V_{R1}/R_1$. A voltage mirror may be used instead, and a second resistor $R_2$ that has a value of $R_2=NR_1$ is used to sense the current $I_1$. The voltage mirror forces the voltages $V_X$ and $V_Y$ to be equal, and the voltages across $R_1$ and $R_2$ are then equal. With $R_2$ N times larger than $R_1$, then $I_2=I_1/N$. Therefore, the main current of $I_1$ is monitored by a much smaller current of $I_2$.

To force the terminal voltages of two transistors or two resistors to be the same, a fast and accurate voltage mirror is required. Therefore it is desirable to construct a high quality voltage mirror with only a few transistors using a very low supply voltage that attains high accuracy, high speed and wide dynamic range.

SUMMARY OF THE INVENTION

According to the present invention there is provided a voltage mirror circuit using a symmetrically matched transistor structure, wherein said circuit comprises an input reference voltage node on a first side of said circuit and an output mirror voltage node on a second side of said circuit, wherein said circuit comprises a plurality of matched transistor pairs wherein the transistors in each pair have the same aspect ratio and wherein one transistor in each pair is provided on the first side of the circuit and the second transistor in each pair is provided on the second side of said circuit.

According to one aspect of the invention there is provided a voltage mirror circuit using a symmetrically matched transistor structure, said circuit comprising: four transistors of a first type, three or four transistors of a second type, first and second high-side nodes, first and second low-side nodes, and six nodes defining connections between said first and second type transistors, wherein:

(a) the first and second terminals of a first first-type transistor are coupled to a first node, and the third terminal of said first first-type transistor is coupled to the second low-side node;

(b) the first terminal of a second first-type transistor is coupled to the first node, the second terminal of the second first-type transistor is coupled to the second node, and the third terminal of the second first-type transistor is coupled to the first low-side node;

(c) the first terminal of a third first-type transistor is coupled to the second node, the second terminal of the third first-type transistor is coupled to the fifth node, and the third terminal of the third first-type transistor is coupled to the second low-side node;

(d) the first terminal of a fourth first-type transistor is coupled to the second node, the second terminal of the fourth first-type transistor is coupled to the sixth node, and the third terminal of the fourth first-type transistor is coupled to the first low-side node;

(e) the first terminal of a first second-type transistor is coupled to the fourth node, the second terminal of the first second-type transistor is coupled to the first node, and the third terminal of the first second-type transistor is coupled to the first high-side node;

(f) the first terminal of a second second-type transistor is coupled to the third node, the second terminal of the second second-type transistor is coupled to the second node, and the third terminal of the second second-type transistor is coupled to the second high-side node;

(g) the first and second terminals of a third second-type transistor are coupled to the fifth node, and the third terminal of the third second-type transistor is coupled to the first high-side node;

(h) the first and second terminals of a fourth second-type transistor are coupled to the sixth node, and the third terminal of the fourth second-type transistor is coupled to the second high-side node;

wherein the third and fourth nodes may both be coupled to the fifth and/or sixth nodes, and wherein if the third and fourth nodes are coupled to the fifth node and not to the sixth node the fourth second-type transistor may be replaced by a current passing device, and wherein if the third and fourth nodes are both coupled to the sixth node and not to the fifth node the third second-type transistor may be replaced by a current passing device.

In one embodiment of a circuit according to this aspect of the invention, the first-type transistors are NMOS transistors and the second-type transistors are PMOS transistors. In such an embodiment the first, second and third terminals are respectively the gate, drain and source of the NMOS and PMOS transistors. Alternatively the first-type transistors may be bipolar npn transistors and the second-type transistors may be bipolar pnp transistors, in which embodiment first, second and third terminals are respectively the base, collector and emitter of the bipolar npn and pnp transistors.

Preferably the voltage at the first low-side node serves as the reference voltage node and the voltage at the second low-side node serves as the mirror voltage. The first and second high-side nodes may be coupled to a fixed voltage node.

In another embodiment of the invention the voltage at the first high-side node serves as the reference voltage node and the voltage at the second high-side node serves as the mirror voltage node. The first and second low-side nodes may be coupled to a fixed voltage node.

Preferably the aspect ratios of the first to fourth first-type transistors are in the ratios P:Q:R:S, where P, Q, R and S can be any positive real numbers, and the aspect ratios of the first to fourth second transistors are also in the ratios P:Q:R:S.

In another aspect the present invention provides a voltage mirror circuit using a symmetrically matched transistor structure, said circuit, said circuit comprising: four transistors of a first type, three or four transistors of a second type transistors, two high-side nodes, two low-side nodes, and six nodes defining connections between said first and second type transistors, wherein;

(a) the first and second terminals of a first first-type transistor are coupled to the first node, and the third terminal of the first first-type transistor is coupled to the second high-side node;

(b) the first terminal of a second first-type transistor is coupled to the first node, the second terminal of the second first-type transistor is coupled to the second node, and the third terminal of the second first-type transistor is coupled to the first high-side node;

(c) the first terminal of a third first-type transistor is coupled to the second node, the second terminal of the third first-type transistor is coupled to the fifth node, and the third terminal of the third first-type transistor is coupled to the second high-side node;

(d) the first terminal of a fourth first-type transistor is coupled to the second node, the second terminal of the fourth first-type transistor is coupled to the sixth node, and the third terminal of the fourth first-type transistor is coupled to the first high-side node;

(e) the first terminal of a first second-type transistor is coupled to the fourth node, the second terminal of the first second-type transistor is coupled to the first node, and the third terminal of the first second-type transistor is coupled to the first low-side node;

(f) the first terminal of a second second-type transistor is coupled to the third node, the second terminal of the second second-type transistor is coupled to the second node, and the third terminal of the second second-type transistor is coupled to the second low-side node;

(g) the first and second terminals of a third second-type transistor are coupled to the fifth node, and the third terminal of the third second-type transistor is coupled to the first low-side node;

(h) the first and second terminals of a fourth second-type transistor are coupled to the sixth node, and the third terminal of the fourth second-type transistor is coupled to the second low-side node;

wherein the third and fourth nodes may both be coupled to the fifth and/or sixth nodes, and wherein if the third and fourth nodes are coupled to the fifth node and not to the sixth node the fourth second-type transistor may be replaced by a current passing device, and wherein if the third and fourth nodes are both coupled to the sixth node and not to the fifth node the third second-type transistor may be replaced by a current passing device.

In an embodiment of this aspect of the invention the first-type transistors are PMOS transistors and the second-type transistors are NMOS transistors. In such an embodiment the first, second and third terminals are respectively the gate, drain and source of the PMOS and NMOS transistors.

In another embodiment of this aspect of the invention the first-type transistors are bipolar pnp transistors and the second-type transistors are bipolar npn transistors. In such am embodiment the first, second and third terminals are respectively the base, collector and emitter of the bipolar pnp and npn transistors.

The voltage at the first low-side node may serve as the reference voltage node and the voltage at the second low-side node serves as the mirror voltage. In such a case the first and second high-side nodes may be coupled to a fixed voltage node.

Alternatively the voltage at the first high-side node may serve as the reference voltage node and the voltage at the second high-side node serves as the mirror voltage node. In such a case the first and second low-side nodes may be coupled to a fixed voltage node.

BRIEF DESCRIPTION OF THE DRAWINGS

Some embodiments of the invention will now be described by the way of non-limitative example and with reference to the accompanying drawings, in which.

DETAILED DESCRIPTION OF THE INVENTION

In this description the terms "matched transistors" and "symmetrically matched transistors" will be used. A pair of transistors $M_A$ and $M_B$ are said to be matched if the aspect ratios (or W/L ratios) of the transistors are proportional to their respective drain currents, that is, $(W/L)_{MA}:(W/L)_{MB}=I_{dMA}:I_{dMB}$. A pair of transistors $M_X$ and $M_Y$ are said to be symmetrically matched if in addition to the aspect ratios (or W/L ratios) of the transistors being proportional to their respective drain currents, that is, $(W/L)_{MX}:(W/L)_{MY}=I_{dMX}:I_{dMY}$, their gate to source voltages and their drain to source voltages are the same, that is $V_{gsMX}=V_{gsMY}$, and $V_{dsMX}=V_{dsMY}$.

Figure 1:
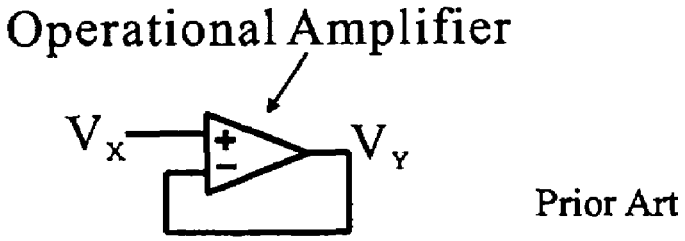
FIG. 1 illustrates a prior art voltage mirror using an operational amplifier.
Figure 2:
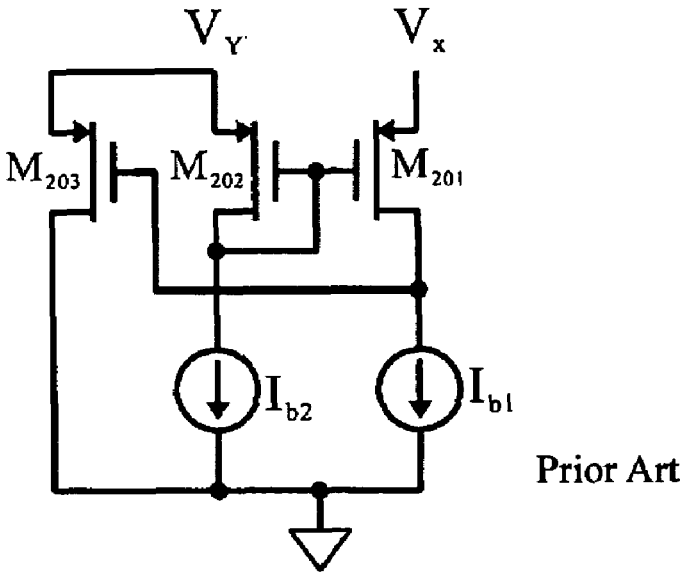
FIG. 2 illustrates a prior art voltage mirror with matched current sources.
Figure 3:
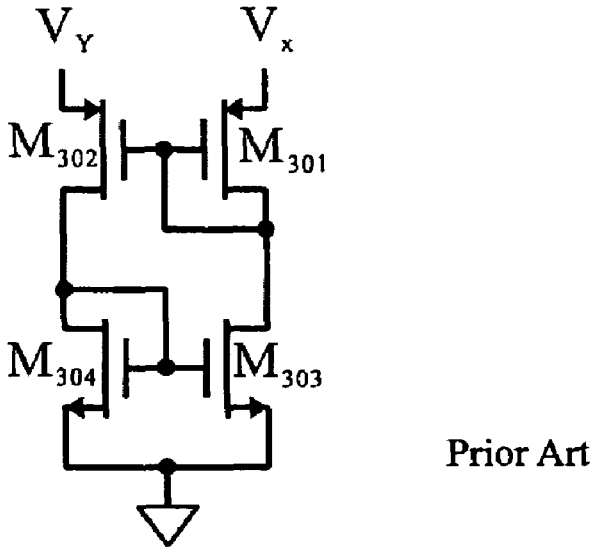
FIG. 3 illustrates a prior art four-transistor self-biased voltage mirror.
Figure 4:
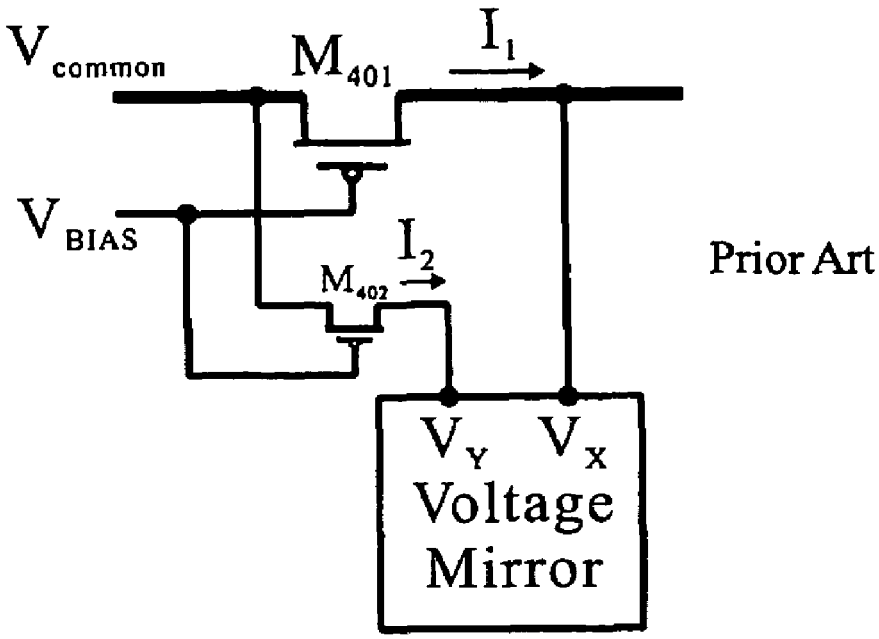
FIG. 4 illustrates a current sensor comprising a voltage mirror with matched transistors.
Figure 5:
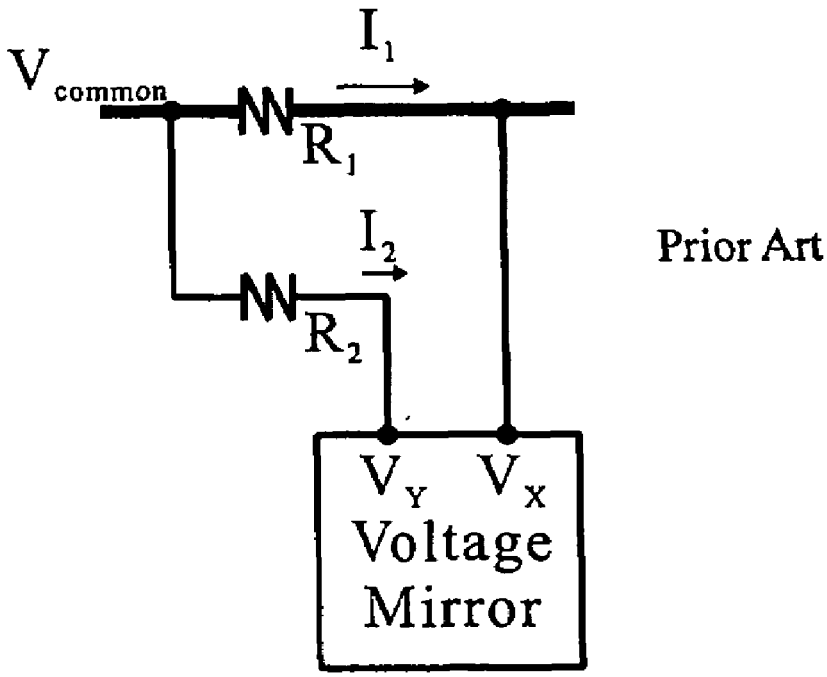
FIG. 5 illustrates a current sensor comprising a voltage mirror and two resistors.
Figure 6:
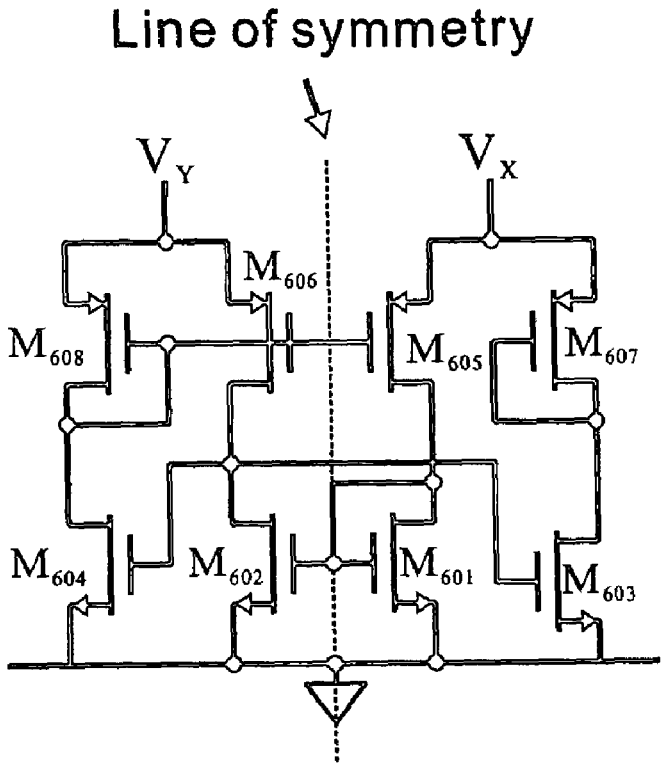
FIG. 6 illustrates a circuit schematic of an embodiment of the present invention comprising one example of an N-type symmetrically matched voltage mirror.

FIG. 6 shows the circuit schematic of a symmetrically matched voltage mirror according to an embodiment of the invention. The circuit comprises four transistor pairs: ($M_{601}$, $M_{602}$), ($M_{603}$, $M_{604}$), ($M_{605}$, $M_{606}$) and ($M_{607}$, $M_{608}$). The transistors in each pair have the same aspect ratio. The circuit may be considered to be divided by a line of symmetry and on one side of the line of symmetry an input voltage $V_X$ is applied, while the mirrored output voltage $V_Y$ is generated from the other side of the line of symmetry. The four transistors are symmetrical about a line of symmetry such that in each transistor pair one transistor ($M_{601}$, $M_{603}$, $M_{605}$, and $M_{607}$) is disposed on the input side of the line of symmetry, and the other transistor in each pair ($M_{602}$, $M_{604}$, $M_{605}$ and $M_{608}$) is disposed on the output side of the line of symmetry. The negative feedback action forces all the corresponding terminal voltages of the transistors in the same pair to be the same, and as such, $V_Y$ is equal to $V_X$.

Figure 7:
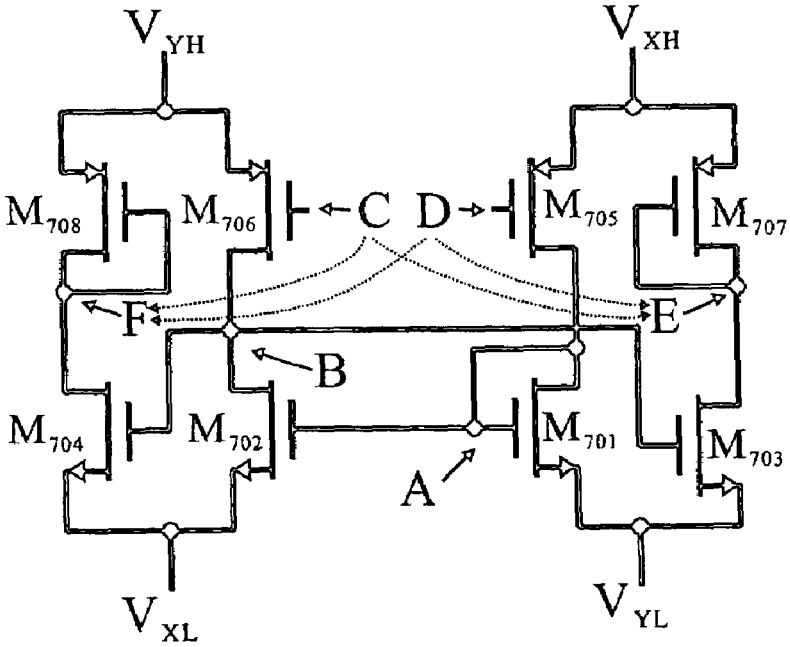
FIG. 7 illustrates a circuit schematic of an embodiment of the present invention comprising a generalized N-type symmetrically matched voltage mirror.
Figure 8:
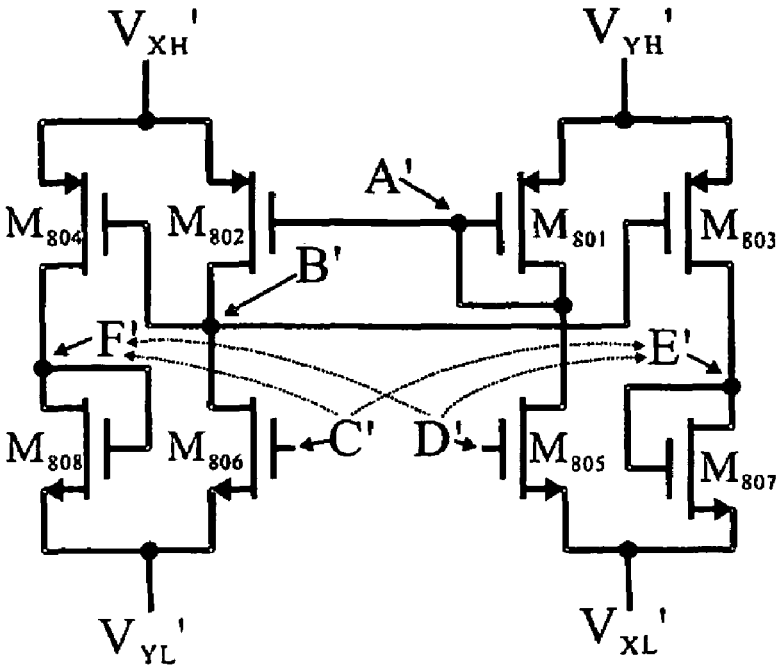
FIG. 8 illustrates a circuit schematic of an embodiment of the present invention comprising a generalized P-type symmetrically matched voltage mirror.

FIGS. 7 and 8 illustrate alternative embodiments of circuits that provide the same voltage mirroring effect.

FIG. 7 shows the circuit schematic of one of the preferred embodiments of the present invention. In particular, FIG. 7 shows an N-type symmetrically matched voltage mirror which comprises four PMOS (P-type metal oxide semiconductor) transistors $M_{701}$, $M_{702}$, $M_{703}$ and $M_{704}$, four NMOS (N-type metal oxide semiconductor) transistors $M_{705}$, $M_{706}$, $M_{707}$ and $M_{708}$, two high-side nodes $V_{XH}$ and $V_{YH}$, two low-side nodes $V_{XL}$ and $V_{YL}$, a node A, a node B, a node C, a node D, a node E and a node F.

The node C may either be coupled to the node E or to the node F or to both the node E and the node F. The node D may either be coupled to the node E or to the node F or to both the node E and the node F. If both the node C and the node D are coupled to the node E only, the PMOS transistor $M_{708}$ may be replaced by a current passing device. Similarly, if both the node C and the node D are coupled to the node F only, the PMOS transistor $M_{707}$ may be replaced by a current passing device. A current passing device may comprise any component that conducts current. For example, a current passing device may comprise a resistor, a diode, or simply a wire.

When using the node $V_{XL}$ as the reference voltage node and the node $V_{YL}$ as the mirror voltage node, the nodes $V_{XH}$ and $V_{YH}$ may be coupled to a fixed voltage node. Similarly, when using the node $V_{XH}$ as the reference voltage node and the node $V_{YH}$ as the mirror voltage node, the nodes $V_{XL}$ and $V_{YL}$ may be coupled to a fixed voltage node. If the W/L ratios of the PMOS transistors $M_{701}$, $M_{702}$, $M_{703}$ and $M_{704}$ are $(W/L)_{M701}:(W/L)_{M702}:(W/L)_{M703}:(W/L)_{M704}=P:Q:R:S$, then the W/L ratios of the NMOS transistors $M_{705}$, $M_{706}$, $M_{707}$ and $M_{708}$ should also be $(W/L)_{M705}:(W/L)_{M706}:(W/L)_{M707}:(W/L)_{M708}=P:Q:R:S$, where P, Q, R and S can be any positive real numbers. It is called an N-type symmetrically matched voltage mirror because the common gate connection occurs at the NMOS pair ($M_{701}$, $M_{702}$), while the gates of the PMOS pairs ($M_{705}$, $M_{706}$) and ($M_{707}$, $M_{708}$) do not need to have a common gate connection.

In the circuit of FIG. 7 first NMOS transistor $M_{701}$ has both of its gate and its drain coupled to the node A, and its source coupled to the node $V_{YL}$; second NMOS transistor $M_{702}$ has its gate coupled to the node A, its drain coupled to the node B, and its source coupled to the node $V_{XL}$; third NMOS transistor $M_{703}$ has its gate coupled to the node B, its drain coupled to the node E, and its source coupled to the node $V_{YL}$; fourth NMOS transistor $M_{704}$ has its gate coupled to the node B, its drain coupled to the node F, and its source coupled to the node $V_{XL}$; first PMOS transistor $M_{705}$ has its gate coupled to the node D, its drain coupled to the node A, and its source coupled to the node $V_{XH}$; second PMOS transistor $M_{706}$ has its gate coupled to the node C, its drain coupled to the node B, and its source coupled to the node $V_{YH}$; third PMOS transistor $M_{707}$ has both of its gate and its drain coupled to the node E, and its source coupled to the node $V_{XH}$; and fourth PMOS transistor $M_{708}$ has both of its gate and its drain coupled to the node F, and its source coupled to the node $V_{YH}$.

Persons skilled in the art will appreciate that the assignment of names to the transistors and the nodes of FIG. 7 is arbitrary and is done for the sake of easy discussion, but does not pose a limitation to the operation of the circuit.

FIG. 8 shows the circuit schematic of another preferred embodiment of the present invention. In particular, FIG. 8 shows a P-type symmetrically matched voltage mirror which comprises four PMOS transistors $M_{801}$, $M_{802}$, $M_{803}$ and $M_{804}$, four NMOS transistors $M_{805}$, $M_{806}$, $M_{807}$ and $M_{808}$, two high-side nodes $V_{XH}'$ and $V_{YH}'$, two low-side notes $V_{XL}'$ and $V_{YL}'$, a node A', a node B', a node C', a node D', a node E' and a node F'.

The node C' may either be coupled to the node E' or to the node F' or to both the node E' and the node F'. The node D' may either be coupled to the node E' or to the node F' or to both the node E' and the node F'. If both the node C' and the node D' are coupled to the node E' only, the NMOS transistor $M_{808}$ may be replaced by a current passing device. Similarly, if both the node C' and the node D' are connected to the node F' only, the NMOS transistor $M_{807}$ may be replaced by a current passing device. A current passing device may comprise any component that conducts current. For example, a current passing device may comprise a resistor, a diode, or simply a wire.

When using the nodes $V_{XL}'$ as the reference voltage node and $V_{YL}'$ as the mirror voltage node, the nodes $V_{XH}'$ and $V_{YH}'$ can be coupled to a fixed voltage node. Similarly, when using the node $V_{XH}'$ as the reference node and the node $V_{YH}'$ as the mirror voltage node, the nodes $V_{XL}'$ and $V_{YL}'$ may be coupled to a fixed voltage node. If the W/L ratios of the PMOS transistors $M_{801}$, $M_{802}$, $M_{803}$ and $M_{804}$ are $(W/L)_{M801}:(W/L)_{M802}:(W/L)_{M803}:(W/L)_{M804}=P':Q':R':S'$, then the W/L ratios of the NMOS transistors $M_{805}$, $M_{806}$, $M_{807}$ and $M_{808}$ should also be $(W/L)_{M805}:(W/L)_{M806}:(W/L)_{M807}:(W/L)_{M808}=P':Q':R':S'$, where P', Q', R' and S' can be any positive real numbers.

In the circuit of FIG. 8 first PMOS transistor $M_{801}$ has both of its gate and its drain coupled to the node A', and its source coupled to the node $V_{YH}'$; second PMOS transistor $M_{802}$ has its gate coupled to the node A', its drain coupled to the node B', and its source coupled to the node $V_{XH}'$; third PMOS transistor $M_{803}$ has its gate coupled to the node B', its drain coupled to the node E', and its source coupled to the node $V_{YH}'$; fourth PMOS transistor $M_{804}$ has its gate coupled to the node B', its drain coupled to the node F', and its source coupled to the node $V_{XH}'$; first NMOS transistor $M_{805}$ has its gate coupled to the node D', its drain coupled to the node A', and its source coupled to the node $V_{XL}'$; second NMOS transistor $M_{806}$ has its gate coupled to the node C', its drain coupled to the node B', and its source coupled to the node $V_{YL}'$; third NMOS transistor $M_{807}$ has both of its gate and its drain coupled to the node E', and its source coupled to the node $V_{XL}'$; and fourth NMOS transistor $M_{808}$ has both of its gate and its drain coupled to the node F', and its source coupled to the node $V_{YL}'$.

Persons skilled in the art will appreciate that the assignment of names to the transistors and the nodes of FIG. 8 is arbitrary and is done for the sake of easy discussion, but does not pose a limitation to the operation of the circuit.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to persons skilled in the art that modifications may be made in the embodiment chosen for illustration without departing from the spirit and scope of the invention. Specifically, it will be apparent to one of ordinary skill in the art that devices in accordance with the present invention could be implemented in several different ways and the apparatus disclosed above is only illustrative of a preferred embodiment of the invention and is in no way a limitation. For example, it would be within the scope of the invention to vary the values of the various components disclosed herein.

Figure 9:
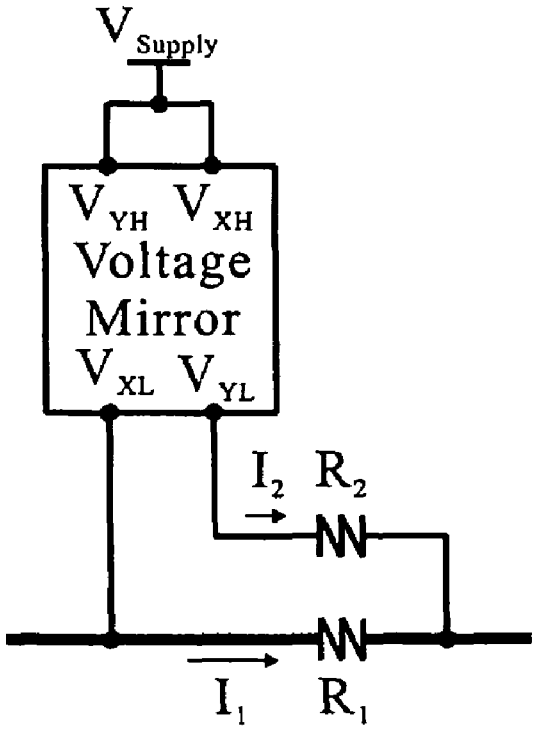
FIG. 9 illustrates a circuit schematic of an embodiment of a current sensor for sensing resistor current using the voltage mirror shown in FIG. 7 or FIG. 8 in accordance with the present invention.

FIG. 9 shows a block diagram of an embodiment of a current sensor that senses the current $I_1$ passing through a very low value resistor $R_1$. A voltage mirror that has a structure of either FIG. 7 or FIG. 8 is used. The sensed current $I_2$ is achieved by a resistor $R_2$, with $R_2=NR_1$. Both of the two high-side nodes $V_{XH}$ and $V_{YH}$ are connected to a supply voltage. The voltage mirror forces the low-side nodes $V_{YL}$ and $V_{XL}$ to be equal, and the sensed current $I_2$ through the resistor $R_2$ is then equal to $I_1/N$.

Figure 10:
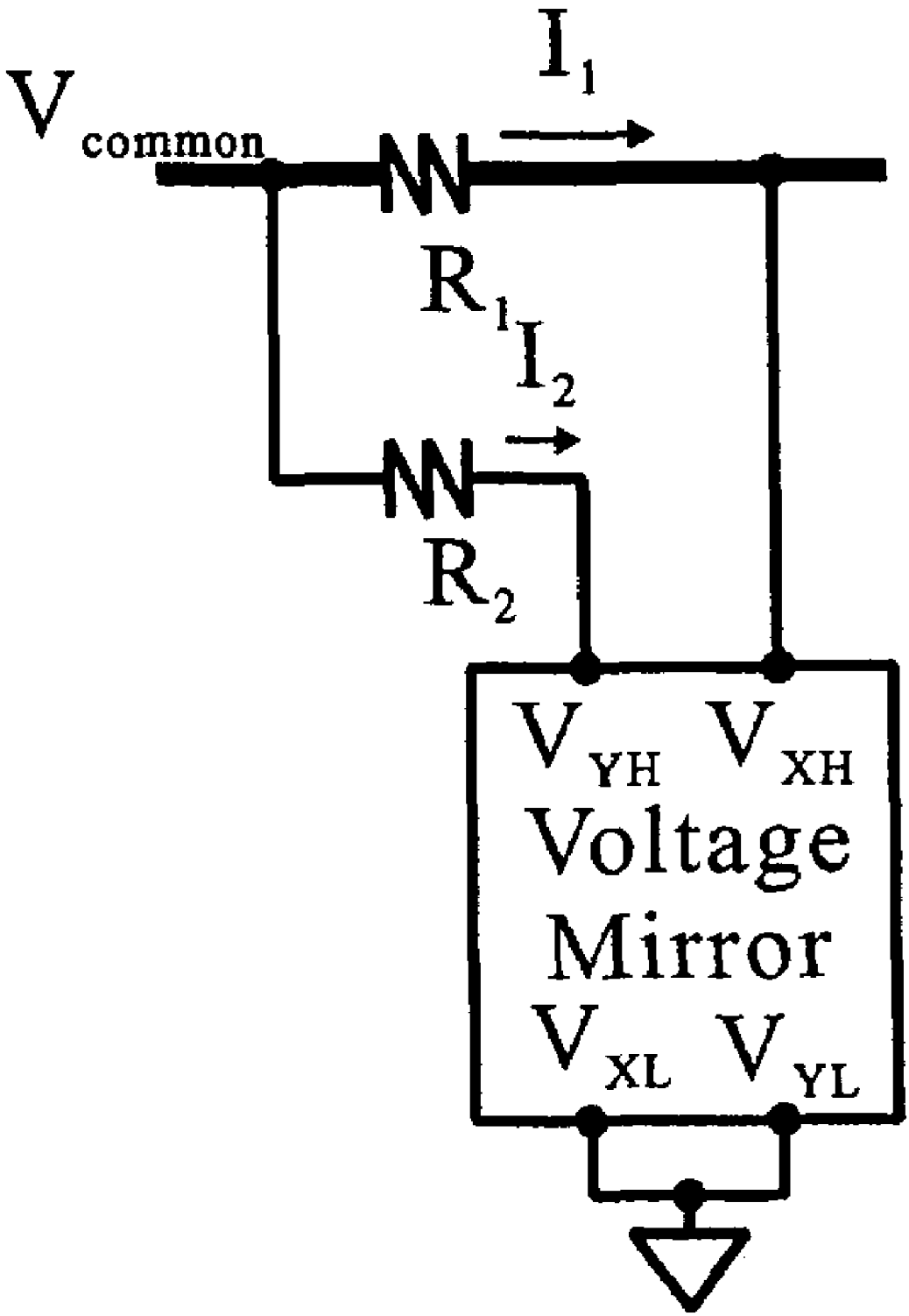
FIG. 10 illustrates a circuit schematic of another embodiment of a current sensor for sensing resistor current using the voltage mirror shown in FIG. 7 or FIG. 8 in accordance with the present invention.

FIG. 10 shows a block diagram of another embodiment of a current sensor that senses the current $I_1$ passing through a very low value resistor $R_1$. A voltage mirror that has a structure of either FIG. 7 or FIG. 8 is used. The sensed current $I_2$ is achieved by a resistor $R_2$, with $R_2=NR_1$. Both of the two low-side nodes $V_{XL}$ and $V_{YL}$ are connected to a supply voltage. The voltage mirror forces the high-side nodes $V_{YH}$ and $V_{XH}$ to be equal, and the sensed current $I_2$ through the resistor $R_2$ is then equal to $I_1/N$.

It will be understood by a skilled person that while the above description has been of circuits using NMOS and PMOS transistors, they may be replaced by bipolar npn and pnp transistors respectively.

It will thus be seen that at least in its preferred embodiments the present invention provides symmetrically matched transistor structures to implement voltage mirrors that force two designated nodes in a circuit to have the same voltage potential. In two preferred embodiments one structure is an N-type symmetrically matched voltage mirror, and the second structure is a P-type symmetrically matched voltage mirror.

In one embodiment, the present invention achieves voltage mirroring by adjusting the currents injected to or drawn from the two designated nodes adaptively. By employing a symmetrically matched structure of the present invention, paired transistors have the same corresponding terminal voltages and thus the same current densities, and voltage mirroring is performed with reduced systematic offset and finite gain error. By identifying the positive feedback loop and negative feedback loop and connecting the two designated nodes properly, stability is unconditionally satisfied, and no frequency compensation capacitor is needed such that high speed is achieved. The present invention does not need any cascode structure, and the voltage mirrors can operate with a very low supply voltage. The biasing current adjusts adaptively according to the currents injected to or drawn from the designated nodes, and wide dynamic range is achieved.

Embodiments of the present invention may be used in current sensors, bandgap references, negative impedance converters, current programming switching converters, current programming linear regulators and current conveyors, for example.

What is claimed is:

1. A voltage mirror circuit using a symmetrically matched transistor structure, said circuit comprising: four transistors of a first type, three or four transistors of a second type, first and second high-side nodes, first and second low-side nodes, and six nodes defining connections between said first and second type transistors, wherein:

(a) the first and second terminals of a first first-type transistor are coupled to a first node, and the third terminal of said first first-type transistor is coupled to the second low-side node;

(b) the first terminal of a second first-type transistor is coupled to the first node, the second terminal of the second first-type transistor is coupled to the second node, and the third terminal of the second first-type transistor is coupled to the first low-side node;

(c) the first terminal of a third first-type transistor is coupled to the second node, the second terminal of the third first-type transistor is coupled to the fifth node, and the third terminal of the third first-type transistor is coupled to the second low-side node;

(d) the first terminal of a fourth first-type transistor is coupled to the second node, the second terminal of the fourth first-type transistor is coupled to the sixth node, and the third terminal of the fourth first-type transistor is coupled to the first low-side node;

(e) the first terminal of a first second-type transistor is coupled to the fourth node, the second terminal of the first second-type transistor is coupled to the first node, and the third terminal of the first second-type transistor is coupled to the first high-side node;

(f) the first terminal of a second second-type transistor is coupled to the third node, the second terminal of the second second-type transistor is coupled to the second node, and the third terminal of the second second-type transistor is coupled to the second high-side node;

(g) the first and second terminals of a third second-type transistor are coupled to the fifth node, and the third terminal of the third second-type transistor is coupled to the first high-side node;

(h) the first and second terminals of a fourth second-type transistor are coupled to the sixth node, and the third terminal of the fourth second-type transistor is coupled to the second high-side node;

wherein the third and fourth nodes may both be coupled to one or both of the fifth and sixth nodes, and wherein if the third and fourth nodes are coupled to the fifth node and not to the sixth node the fourth second-type transistor may be replaced by a current passing device, and wherein if the third and fourth nodes are both coupled to the sixth node and not to the fifth node the third second-type transistor may be replaced by a current passing device.

2. A circuit as claimed in claim 1 wherein said first-type transistors are NMOS transistors and said second-type transistors are PMOS transistors.

3. A circuit as claimed in claim 2 wherein the first, second and third terminals are respectively the gate, drain and source of the NMOS and PMOS transistors.

4. A circuit as claimed in claim 1 wherein said first-type transistors are bipolar npn transistors and said second-type transistors are bipolar pnp transistors.

5. A circuit as claimed in claim 4 wherein the first, second and third terminals are respectively the base, collector and emitter of the bipolar npn and pnp transistors.

6. A circuit as claimed in claim 1 wherein the voltage at the first low-side node serves as the reference voltage node and the voltage at the second low-side node serves as the mirror voltage.

7. A circuit as claimed in claim 6 wherein the first and second high-side nodes are coupled to a fixed voltage node.

8. A circuit as claimed in claim 1 wherein the voltage at the first high-side node serves as the reference voltage node and the voltage at the second high-side node serves as the mirror voltage node.

9. A circuit as claimed in claim 8 wherein the first and second low-side nodes are coupled to a fixed voltage node.

10. A circuit as claimed in claim 1 wherein the aspect ratios of the first to fourth first-type transistors are in the ratios P:Q:R:S, where P, Q, R and S can be any positive real numbers, and wherein the aspect ratios of the first to fourth second-type transistors are also in the ratios P:Q:R:S.

11. A circuit as claimed in claim 1 wherein said current passing element comprises any conductive element which can conduct current.

12. A voltage mirror circuit using a symmetrically matched transistor structure, said circuit comprising: four transistors of a first type, three or four transistors of a second type, two high-side nodes, two low-side nodes, and six nodes defining connections between said first and second type transistors, wherein;

(a) the first and second terminals of a first first-type transistor are coupled to the first node, and the third terminal of the first first-type transistor is coupled to the second high-side node;

(b) the first terminal of a second first-type transistor is coupled to the first node, the second terminal of the second first-type transistor is coupled to the second node, and the third terminal of the second first-type transistor is coupled to the first high-side node;

(c) the first terminal of a third first-type transistor is coupled to the second node, the second terminal of the third first-type transistor is coupled to the fifth node, and the third terminal of the third first-type transistor is coupled to the second high-side node;

(d) the first terminal of a fourth first-type transistor is coupled to the second node, the second terminal of the fourth first-type transistor is coupled to the sixth node, and the third terminal of the fourth first-type transistor is coupled to the first high-side node;

(e) the first terminal of a first second-type transistor is coupled to the fourth node, the second terminal of the first second-type transistor is coupled to the first node, and the third terminal of the first second-type transistor is coupled to the first low-side node;

(f) the first terminal of a second second-type transistor is coupled to the third node, the second terminal of the second second-type transistor is coupled to the second node, and the third terminal of the second second-type transistor is coupled to the second low-side node;

(g) the first and second terminals of a third second-type transistor are coupled to the fifth node, and the third terminal of the third second-type transistor is coupled to the first low-side node;

(h) the first and second terminals of a fourth second-type transistor are coupled to the sixth node, and the third terminal of the fourth second-type transistor is coupled to the second low-side node;

wherein the third and fourth nodes may both be coupled to one or both of the fifth and sixth nodes, and wherein if the third and fourth nodes are coupled to the fifth node and not to the sixth node the fourth second-type transistor may be replaced by a current passing device, and wherein if the third and fourth nodes are both coupled to the sixth node and not to the fifth node the third second-type transistor may be replaced by a current passing device.

13. A circuit as claimed in claim 12 wherein said first-type transistors are PMOS transistors and said second-type transistors are NMOS transistors.

14. A circuit as claimed in claim 13 wherein the first, second and third terminals are respectively the gate, drain and source of the PMOS and NMOS transistors.

15. A circuit as claimed in claim 12 wherein said first-type transistors are bipolar pnp transistors and said second-type transistors are bipolar npn transistors.

16. A circuit as claimed in claim 15 wherein the first, second and third terminals are respectively the base, collector and emitter of the bipolar pnp and npn transistors.

17. A circuit as claimed in claim 12 wherein the voltage at the first low-side node serves as the reference voltage node and the voltage at the second low-side node serves as the mirror voltage.

18. A circuit as claimed in claim 17 wherein the first and second high-side nodes are coupled to a fixed voltage node.

19. A circuit as claimed in claim 12 wherein the voltage at the first high-side node serves as the reference voltage node and the voltage at the second high-side node serves as the mirror voltage node.

20. A circuit as claimed in claim 19 wherein the first and second low-side nodes are coupled to a fixed voltage node.

21. A circuit as claimed in claim 12 wherein the aspect ratios of the first to fourth first-type transistors are in the ratios P:Q:R:S, where P, Q, R and S can be any positive real numbers, and wherein the aspect ratios of the first to fourth second-type transistors are also in the ratios P:Q:R:S.

22. A circuit as claimed in claim 12 wherein said current passing element comprises any conductive element which can conduct current.

* * * * *